US010427817B2

(12) United States Patent
Sander et al.

(10) Patent No.: US 10,427,817 B2
(45) Date of Patent: Oct. 1, 2019

(54) SHAFT SYSTEM COMPRISING A PLURALITY OF RECEIVING SHAFTS ARRANGED IN PARALLEL SIDE BY SIDE FOR RECEIVING FOIL BAGS

(71) Applicant: INDAG Pouch Partners GmbH, Eppelheim (DE)

(72) Inventors: Jörg Sander, Heidelberg (DE); Roland Treu, Nußloch (DE); Sönke Hartung-Rey, Heidelberg (DE)

(73) Assignee: INDAG POUCH PARTNERS GMBH, Eppelheim (DE)

( * ) Notice: Subject to any disclaimer, the term of this patent is extended or adjusted under 35 U.S.C. 154(b) by 0 days.

(21) Appl. No.: 15/571,667

(22) PCT Filed: Mar. 10, 2017

(86) PCT No.: PCT/EP2017/055693
§ 371 (c)(1),
(2) Date: Nov. 3, 2017

(87) PCT Pub. No.: WO2017/153582
PCT Pub. Date: Sep. 14, 2017

(65) Prior Publication Data

US 2018/0148205 A1 May 31, 2018

(30) Foreign Application Priority Data

Mar. 11, 2016 (EP) ..... 16159775

(51) Int. Cl.
*B65B 43/14* (2006.01)
*B65B 59/04* (2006.01)
(Continued)

(52) U.S. Cl.
CPC ..... *B65B 43/14* (2013.01); *B65B 59/04* (2013.01); *B65H 1/06* (2013.01); *B65H 1/28* (2013.01);
(Continued)

(58) Field of Classification Search
CPC ..... B65B 43/14; B65B 59/04; B65H 1/06; B65H 1/28; B65H 2511/12; B65H 2511/10
(Continued)

(56) References Cited

U.S. PATENT DOCUMENTS 5,263,701 A * 11/1993 Kleinhen ..... B62B 3/008 220/4.28
5,467,949 A * 11/1995 Lemke ..... B65B 67/1233 211/85.15
(Continued)

FOREIGN PATENT DOCUMENTS

DE 69607594 T2 12/2000
DE 102013105913 A1 12/2014
(Continued)

OTHER PUBLICATIONS

The extended European search report dated Dec. 5, 2016 and received in EP Application No. 16159775.2.

*Primary Examiner* — Muhammad Ijaz
(74) *Attorney, Agent, or Firm* — Mayer Brown LLP

(57) ABSTRACT

The invention relates to a shaft system comprising a plurality of receiving shafts arranged in parallel side by side for receiving foil bags, wherein the receiving shafts are bordered by walls formed by exchangeable format parts, wherein as a result of the exchange of the format parts the width and/or contour of the receiving shafts and/or the shape of retaining elements of the format parts is variable.

16 Claims, 4 Drawing Sheets

(51) Int. Cl.
*B65H 1/06* (2006.01)
*B65H 1/28* (2006.01)

(52) U.S. Cl.
CPC ..... *B65H 2511/10* (2013.01); *B65H 2511/12* (2013.01)

(58) Field of Classification Search
USPC ..... 248/95, 281.11
See application file for complete search history.

(56) References Cited

U.S. PATENT DOCUMENTS 5,611,456 A * 3/1997 Kasper ..... B65H 1/06 221/129
5,753,897 A * 5/1998 Kasper ..... B65H 1/06 221/270
5,829,631 A * 11/1998 Kasper ..... B65H 1/06 221/198
5,857,588 A * 1/1999 Kasper ..... B65H 3/24 221/232
6,056,150 A * 5/2000 Kasper ..... B65H 1/06 209/657
6,367,653 B1 4/2002 Ruskin et al.
8,386,074 B2 * 2/2013 Smith, III ..... G07F 9/006 221/96
2005/0053455 A1 3/2005 Jaspers et al.
2014/0069328 A1 * 3/2014 Houck ..... B65G 59/00 118/300

FOREIGN PATENT DOCUMENTS

EP 0631952 A1 1/1995
EP 0714839 A1 6/1996
EP 0997420 A2 5/2000
EP 1125717 A2 8/2001
EP 2708482 A2 3/2014
WO 2013-182305 A1 12/2013

* cited by examiner

SHAFT SYSTEM COMPRISING A PLURALITY OF RECEIVING SHAFTS ARRANGED IN PARALLEL SIDE BY SIDE FOR RECEIVING FOIL BAGS

RELATED APPLICATIONS

This application is a national stage entry of International Patent Application No. PCT/EP2017/055693, filed Mar. 10, 2017, which claims the benefit of priority to European Patent Application No. 16159775.2, filed Mar. 11, 2016, the contents of both of which are incorporated by reference herein in their entirety.

BACKGROUND

In the processing of foil bags, the foil bags are inserted from above into parallel-arranged receiving shafts and are stacked in the shafts. As a result of gravity conveyance, they are guided along the shafts downwards and are there removed as a row of individual foil bags arranged side by side and are further transported, for instance to be filled with liquid products or to be provided with a spout. They are typically removed by machinery, for instance by way of suction mechanisms.

SUMMARY

In some embodiments, the invention provides a shaft system comprising a plurality of receiving shafts arranged in parallel side by side for receiving foil bags, wherein the receiving shafts are bordered by walls formed by exchangeable format parts comprising retaining elements for retaining the bags in the receiving shafts; and wherein a width and/or contour of the receiving shafts and/or a shape of the retaining elements is changeable by replacing a first group of exchangeable format parts with a second group of exchangeable format parts.

In some embodiments, the format parts comprise recesses, a depth of the recesses of two neighboring format parts defining the width of the receiving shaft bordered by them and a shape of the recesses of two neighboring format parts defining the contour of the receiving shaft bordered by them.

In some embodiments, the format parts of the first group comprise recesses with a different depth and/or shape and/or retaining elements of a different shape than the format parts of the second group.

In some embodiments, the format parts are fixed at a front side of a rear wall of the receiving shafts or of a frame part at a rear side of the receiving shafts, or on side walls of a frame part arranged between two receiving shafts.

In some embodiments, the shaft system further comprises a fastening mechanism for fixing the format parts during operation, wherein the fastening mechanism is independent of a format of the foil bags.

In some embodiments, all elements of the format parts which form part of the fastening mechanism have the same shape in all of the format parts.

In some embodiments, the fastening mechanism is configured such that all degrees of freedom of movement of the format parts are blocked when the format parts are in the fixed state.

In some embodiments, the format parts are fixed in a purely mechanical manner.

In some embodiments, the format parts are fixed by way of form, force and/or friction closure.

In some embodiments, the fastening mechanism is configured to maintain the fixation upon interruption of the energy supply to the shaft system.

In some embodiments, the fastening mechanism comprises at least one of a latching mechanism, a suspension mechanism, and a locking mechanism.

In some embodiments, the format parts each comprise a bolt, and the suspension mechanism for each of the format parts comprises the bolt and an upwardly oriented receptacle configured to receive the bolt.

In some embodiments, the format parts each comprise an element with a bore, and the locking mechanism for each of the format parts comprises the element with the bore and a clamping mechanism.

In some embodiments, the shaft system further comprises a sensor configured to detect whether a respective format part is hung in and/or locked.

In some embodiments, the shaft system further comprises a warning system configured to issue a warning when the sensor detects that no format part is hung in and/or locked.

Additional features and advantages of the present invention are described further below. This summary section is meant merely to illustrate certain features of the invention, and is not meant to limit the scope of the invention in any way. The failure to discuss a specific feature or embodiment of the invention, or the inclusion of one or more features in this summary section, should not be construed to limit the invention as claimed.

BRIEF DESCRIPTION OF THE DRAWINGS

The foregoing summary, as well as the following detailed description of the preferred embodiments of the application, will be better understood when read in conjunction with the appended drawings. For the purposes of illustrating the device of the present application, there are shown in the drawings preferred embodiments. It should be understood, however, that the application is not limited to the precise arrangements and instrumentalities shown. In the drawings.

DETAILED DESCRIPTION

Figure 1:
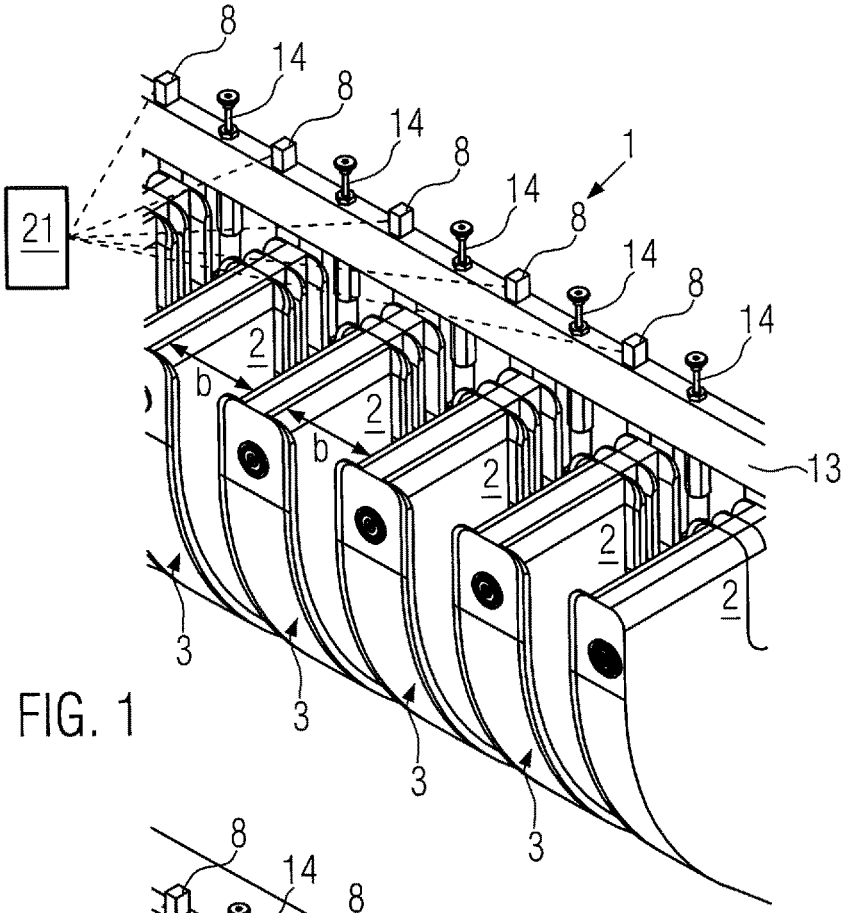
FIG. 1 is a schematic inclined view, which is not true to scale, onto a shaft system with fastened format parts, according to some embodiments of the invention.

As described above, in the processing of foil bags the foil bags are inserted from above into parallel-arranged receiving shafts and are stacked in the shafts. As a result of gravity conveyance, they are guided along the shafts downwards and are there removed as a row of individual foil bags arranged side by side and are further transported, for instance to be filled with liquid products or to be provided with a spout. They are typically removed by machinery, for instance by way of suction mechanisms.

The width of the receiving shafts must here be adapted to the width of the foil bags, so that these are correctly stacked and guided in the shafts. Whenever a format change of the foil bags takes place during processing, their width may change and the width of the receiving shafts has to be adapted accordingly. As an alternative or in addition, the bag length or the bag thickness or the bag thickness difference may also change, so that the contour of the receiving shafts and/or the shape of the retaining elements must be adapted accordingly. For example, guides which are integrally arranged with the side walls of the receiving shafts may have a different inner radius when the bag length is changed.

When the receiving shafts are made integral, all of the receiving shafts, where applicable including a frame, must be replaced. This requires a lot of time and entails high costs of material. Moreover, this configuration is disadvantageous from an ergonomic point of view because integrally configured receiving shafts have a greater weight. It is also possible to arrange the side walls of the receiving shafts such that they are displaceable, and to adapt them to the new bag formats by way of displacement. This, however, is only possible with a constant contour and constant shape of the retaining elements, i.e. at a constant bag length, constant bag thickness and constant bag thickness difference, but not when the bag length, bag thickness or the bag thickness difference changes, because an adjustable contour and an adjustable shape of the retaining elements is technically only feasible to some degree and is troublesome. Moreover, the position of the walls must be precisely measured and adjusted for this, which is troublesome and complicated. A further disadvantage is that the center of the receiving shafts is displaced upon change of the shaft width if displaceable walls are used, unless each wall between two shafts is made of two parts and the position of the two parts is individually adjustable. This, however, would be even more complicated.

It is thus the object of the invention to provide a shaft system that simplifies format change.

The problem is solved by the receiving shafts being bordered by walls which are formed by exchangeable format parts, the width and/or the contour of the receiving shafts and/or the shape of retaining elements of the format parts being variable as a result of the exchange of the format parts.

It is thus possible to flexibly adjust the shaft width and contour and the shape of the retaining elements by exchange of the format parts, and thus to simplify the format change. An adjustment of the position is not required for an exact adjustment of the width because the adjustment can take place solely by mounting individually designed format parts at fixedly predetermined positions. Moreover, the rearrangement can be carried out manually by an operator and no machine drives are needed. To sum up, a simple and fast format change is possible. A further advantage of the above-described shaft system is that the center of the receiving shafts is not shifted upon change of the shaft width.

The bag retaining elements in the receiving shaft allow bag retention in the receiving shaft and must be adapted to the respective bag format, above all to the bag thickness and the bag thickness difference. The bag thickness difference is due to the fact that some bags comprise an unfoldable bottom and are positioned in the receiving shafts in the folded state. At the side where the unfoldable bottom is arranged, more material layers are positioned one upon the other than at the upper end of the bag, so that one end is thicker than the other end.

Preferably, exactly one format part forms a wall between two neighboring receiving shafts. However, two format parts together may also form a wall. Suitably formed format parts can be provided for specific shaft widths or shaft contours and bag formats, respectively, said format parts being selected depending on the bag format to be processed and being fastened at the suitable position.

The format parts may be fastened to a frame by way of a fastening mechanism that is independent of the format, so that the frame need not be exchanged for changing the format. This is advantageous because in this case the whole frame need not be exchanged and the frame can for instance be anchored firmly on the bottom and/or installed in a machine. Furthermore, the weight is much lower so that no lifting mechanism is needed and an ergonomic design is made possible.

The format parts are configured such that the foil bags are guided downwards through the receiving shafts. At the sides which guide the foil bags (hereinafter also called side surfaces of the format parts), the format parts may have recesses, the depth of the recesses of two neighboring format parts defining the width of the receiving shaft bordered by them and the shape of the recesses of two neighboring format parts defining the contour of the receiving shaft bordered by them. When a format part forms the wall for neighboring receiving shafts, it comprises recesses on two opposite surfaces. The above-described recesses are also called lateral recesses.

The width and/or contour of the receiving shafts and/or the shape of the retaining elements can be changed by replacing a first group of exchangeable format parts by a second group of exchangeable format parts, wherein the format parts of the first group comprise recesses with a different depth and/or shape and/or retaining elements of a different shape than the format parts of the second group.

For instance, guides of different format parts may have different inner radii. Different bag lengths can thus be taken into consideration. As an alternative or in addition, the retaining elements, which allow bag retention in the receiving shaft, of different format parts can differ. This is particularly advantageous in the case of different bag thicknesses. Moreover, it can thus be taken into account that in the case of different bag formats the above-described bag thickness difference can be different.

As has already been explained above, the format change can thus be carried out in a simple manner.

The format parts can be fixed during operation by way of a respective fastening mechanism. Fixing is understood to mean that all degrees of freedom of the movement of a format part are blocked. The fastening mechanism can particularly be independent of the format. For instance, uniform format parts can be used with a geometry that just differs in the shaft width and/or shaft contour and/or shape of the retaining elements defined by them.

Specifically, the format parts can be fixed at the front side of a rear wall of the receiving shafts or of a frame part at the rear side of the receiving shafts. Alternatively, the format parts can be fixed on the side walls of a frame part which is arranged between two receiving shafts.

The elements which form part of the fastening mechanism may have the same shape in all format parts. For instance, all format parts are compatible with holding elements which are fastened to the frame or part of the frame, and can be exchanged in any desired manner and in an easy way. Specifically, the thickness of all format parts can be the same. The shape of different format parts can particularly be the same, except for the depth and/or shape of the recesses and/or shape of the retaining elements. This allows easier storage.

The fastening mechanism can be configured such that in the fastened state all degrees of freedom of the movement of a format part, which is fastened to the frame, are blocked. Specifically, translational movements are blocked in all of the three spatial directions and also rotational movements of the format part. To this end a fastening mechanism can particularly be used for hanging in and locking a format part, particularly in such a manner that a hung-in and locked format part is firmly clamped. Specifically, the fastening mechanism can be configured such that the format parts can be changed without tools.

Fixing may take place in a purely mechanical way, particularly through form, force and/or friction closure. This means that solely mechanical forces keep the format parts in their position. An electrical control which controls the position is not required. This simplifies the system and makes it more reliable.

The fastening mechanism can be configured such that the fixation will be maintained when the energy supply to the shaft system is interrupted. Specifically, the fastening mechanism can be configured such that an upper dead center with a higher energy level has to be exceeded for undoing the fixation.

The fastening mechanism can be configured such that a format part is removed against gravity. The fastening mechanism can particularly comprise a suspension mechanism. The suspension mechanism has inter alia the property that a format part can be hung in, whereby a downward movement is prevented. The suspension mechanism can be configured such that unlocked format parts are secured against unintended detachment (falling down) until the intended removal. The fastening mechanism can be configured such that the fastening of the format parts takes place by way of suspension and downward pivoting of the format parts and locking. The fastening mechanism can also be configured as a latching mechanism. This is of particular advantage to a fastening to frame parts that are arranged between two receiving shafts because a space-saving exchange and fastening is possible.

The suspension mechanism may include a holding element and parts of a format part, for instance a bolt. The suspension mechanism can particularly comprise a bolt of the format part and an upwardly oriented receptacle for receiving the bolt.

The holding element can here be fastened to the frame and comprise a vertical passage opening through the holding element. The holding element comprises a hook-like element facing away from the frame, which forms a, particularly conical, receptacle which is configured to receive a bolt and which is oriented upwards during operation.

The format part may comprise a bolt which is part of the suspension mechanism and is configured such that it is received in the receptacle of the hook-like element when the format part is fastened. The bolt is arranged in a rear-side recess in the format part, which recess is configured such that the hook-like element can be received therein and that at least two opposite side surfaces of the holding element rest on the corresponding inner surfaces of the rear-side recess when the format part is hung in, so that a surface contact is created on the side surfaces of the holding element.

The fastening mechanism can comprise a locking mechanism as an alternative or in addition to the suspension mechanism. The locking mechanism can particularly be configured to block an upward movement of the hung-in format parts. The locking mechanism may comprise a clamping mechanism, for instance a clamping mechanism by way of a spring. The lock can here be configured such that the format part can be removed upwards after the lock has been opened. The locking mechanism may comprise an element of the format part with a bore and a clamping mechanism.

The locking mechanism may particularly comprise a holding element or the holding element which is fastened to a rear wall of the receiving shafts or of a frame part at the rear side of the receiving shafts, and a clamping mechanism. The clamping mechanism may comprise a force-operated first pin which extends through the passage opening in the holding element and in which a second pin is resiliently supported, wherein the first pin is vertically movable (along the z-axis) through the passage opening and the second pin is vertically movable in the first pin. The format part comprises a bore which in the hung-in condition of the format part faces upwards and is arranged underneath the second pin. It also forms a part of the locking mechanism. The first pin is configured such that when it is moved downwards, it moves the second pin downwards until the end thereof abuts in the bore in the format part. The end of the second pin can be made conical. The bore can also be made conical. The axis of the pin is not in alignment with the bore axis of the bore in the hung-in state of the format part. The hung-in format part can be locked by the first pin being moved downwards.

The shaft system may comprise a sensor which is configured such that it detects whether a format part is used. The sensor can be arranged in a machine-fixed manner. The sensor may for instance comprise a light barrier. The automatic detection of missing format parts is advantageous because the risk of injury is high when format parts are missing.

The shaft system may comprise a warning system which is configured such that it gives a warning when the sensor detects that no format part is hung in. The warning may be issued optically, haptically and/or acoustically. Moreover, the energy supply to a facility in which the shaft system is installed can be cut off when the sensor detects that no format part is hung in. The device may comprise the sensor or a sensor which detects whether the format parts are locked, and a warning system which gives a warning in case of a missing locking.

Further features and advantages are explained hereinafter by way of the exemplary figures.

FIG. 1 shows a shaft system 1 in an inclined view. Several exchangeable format parts 2 with lateral recesses form the walls between neighboring receiving shafts 3. The format parts are fastened to a frame, in this case to the rear side of the receiving shafts. As can here be seen, each format part, except for the outermost format parts, forms a wall for two neighboring receiving shafts.

The format parts are equidistantly arranged, so that all shafts have the same width. As can here be seen, mutually facing recesses define the width in the format parts as the foil bags are transported in these recesses. The format parts are shown from the side that is subsequently fastened to the holding element.

Moreover, the shape of the recesses defines the contour of the receiving shafts and thus the bag length for which the receiving shafts are designed. For instance, the shape of the recesses forms guides of a specific inner radius.

Figure 2:
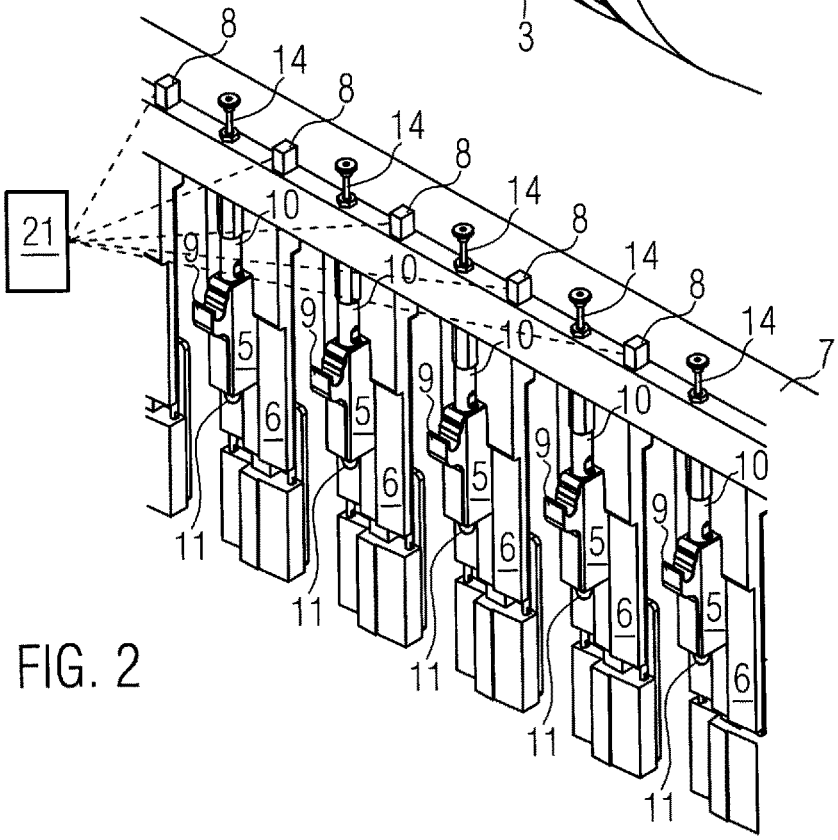
FIG. 2 is a schematic inclined view, which is not true to scale, onto a part of the shaft system of FIG. 1 with removed format parts, according to some embodiments.

FIG. 2 shows the shaft system of FIG. 1, the format parts having been removed in this case. Shown are here adjacently arranged holding elements 5 which are fastened to the frame. Each holding element is respectively fastened to a wall 6 of the frame, the walls being fastened side by side to a cross beam 7. Alternatively, the holding elements may be fastened side by side to a continuous wall. A passage opening extends vertically through the holding element. Moreover, the holding element comprises a hook-like element 9 facing away from the frame, which in this instance forms a conical, upwardly oriented receptacle configured to receive a bolt.

A force-actuated first pin 10 extends through the passage opening. A second pin 11 is resiliently supported in the first pin. The first pin is movable vertically (along the z-axis) through the passage opening. The first pin is configured such that whenever it is moved downwards, it moves the second pin, which is supported therein, downwards until said pin abuts on an obstacle. Upon abutment of the second pin a spring (here not shown, reference numeral 12 in the detail view in FIGS. 6 and 7) of the resilient bearings is compressed. The lower end of the second pin is here made conical. All of the adjacently arranged first pins extend here by way of example through passage openings in a crossbar 13 and are firmly connected to the crossbar. The first pins are connected to the crossbar such that they are operated by adjustment of the height of the crossbar.

By way of example, an actuating element 14 (also called switching flag) projects upwards beyond the crossbar for the manual operation of the second pin. Thus, each of the second pins can be operated manually by the switching flag 14.

It is also possible that only the switching flags are provided for the direct adjustment of the second pins, or only the crossbar for actuating the first pins, which in turn actuate the second pins.

FIG. 2 further shows sensors 8, each detecting whether format parts are hung in and locked. Each sensor is connected to a warning system 21 which issues a warning whenever a format part is missing or is not locked during operation. The sensors 8 are arranged on the crossbar 13 and respectively evaluate the different positions of the switching flags 14.

Figure 4:
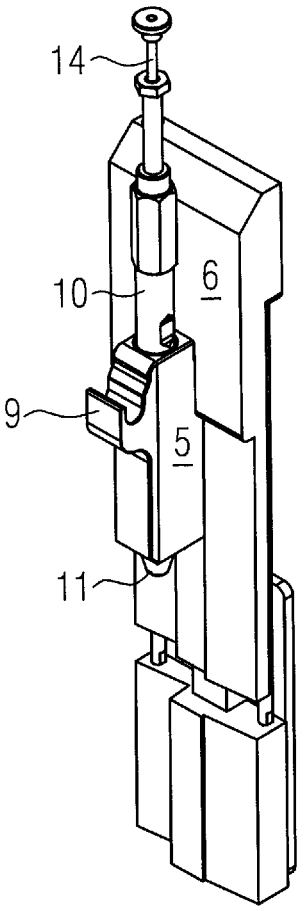
FIG. 4 is a schematic inclined view, which is not true to scale, of a holding element according to some embodiments.

One of the holding elements 5 with the two pins is shown in detail in FIG. 4. The figure is an inclined view onto the front side of the holding element, i.e. the side where a format part is fastened.

Figure 3:
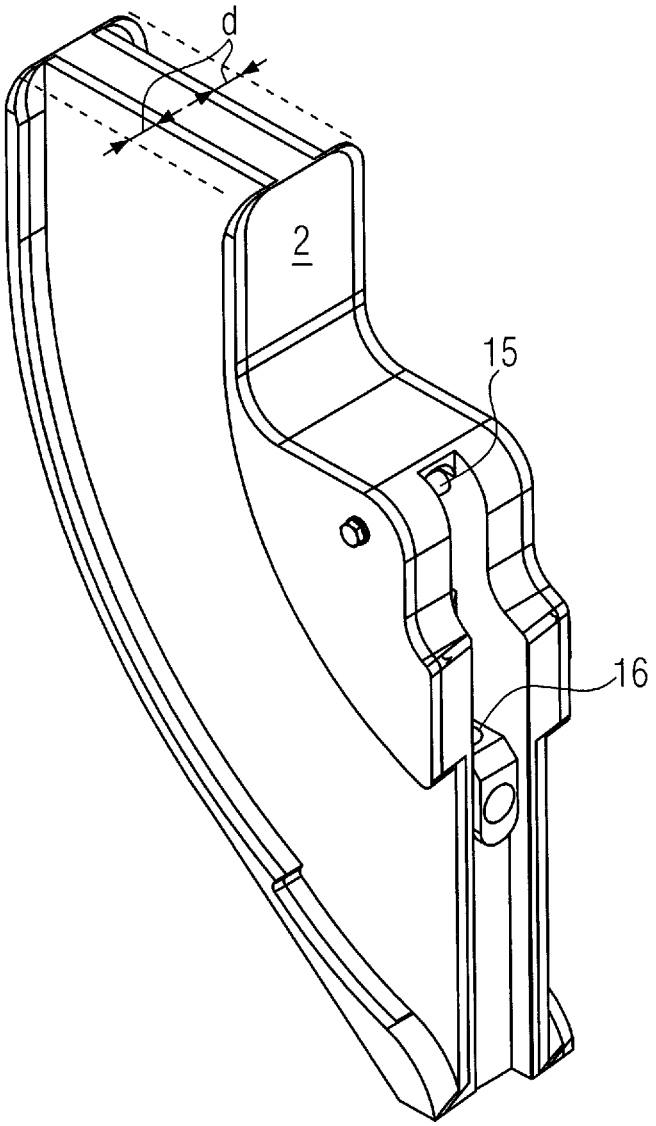
FIG. 3 is a schematic inclined view, which is not true to scale, of a format part according to some embodiments.

FIG. 3 shows a detail view of a format part 2. The figure is an inclined view onto the rear side of the format part, i.e. the side which is fastened to the holding element and oriented towards the wall 6. The format part comprises two recesses of a depth (d) and a bolt 15 which is arranged in a rear-side recess in the format part. The format part comprises an element with a bore 16 which in the hung-in state of the format part faces upwards and is made conical in this example. The element with the bore is also arranged in the rear-side recess.

It should be noted that the format parts may also comprise retaining elements which are adapted to the respective bag format, particularly the bag thickness and the bag thickness difference, of the bags to be processed.

Figure 5:
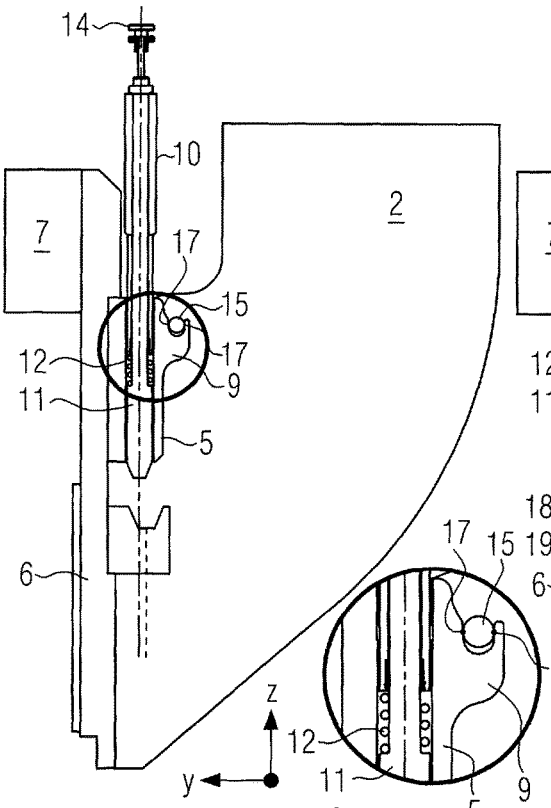
FIG. 5 is a schematic representation, which is not true to scale, of a cut in a vertical plane perpendicular to the row of receiving shafts of a fastening mechanism in the unlocked state, according to some embodiments.

FIG. 5 shows how the format part is hung onto the frame, but is not locked. Here, the above-described spring 12 is shown in the resilient bearing of the second pin. The format part in FIG. 5 is hung in by the bolt being received in the receptacle of the hook-like element. The rear-side recess is formed with the bolt in the format part such that the hook-like element, as is shown here, is received therein. The rear-side recess is downwardly provided with a step, so that it gets deeper there and receives the lower part of the holding element and the lower end of the second pin. In the lowermost portion of the format part said part rests on the wall.

Furthermore, the figure shows that the bore is arranged underneath the second pin. The axis 11*a* of the second pin is, in the hung-in state of the format part, not in alignment with the bore axis 16*a* of the bore.

The first pin is configured such that when it is moved downwards, it moves the second pin downwards until the end thereof abuts in the bore in the format part.

Figure 6:
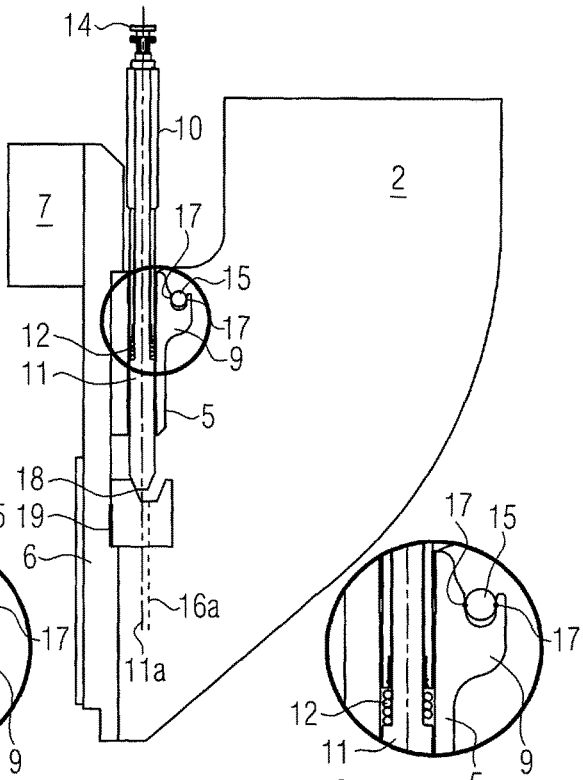
FIG. 6 is a schematic side view, which is not true to scale, of the fastening mechanism from FIG. 5 in the locked state, according to some embodiments.

FIG. 6 shows a format part which is hung in and locked. The hung-in format part is locked by the first pin being moved downwards to such an extent that the conical lower end of the second pin abuts on the conical opening and the spring is compressed.

The figure further shows various surface contacts and line contacts that during the hanging-in and locking operations help to block the movement of the format parts.

Figure 7:
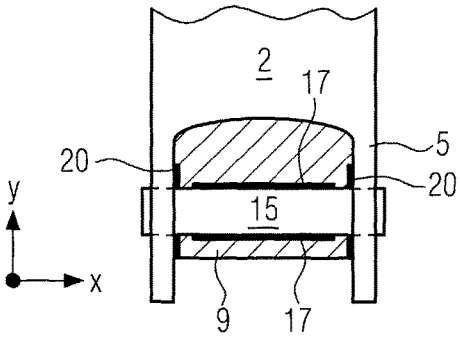
FIG. 7 is a schematic top view, which is not true to scale, onto a suspension mechanism according to some embodiments.

This creates two line contacts 17 between the bolt and the receptacle along the length of the bolt. Furthermore, since the axis of the second pin is not in alignment with the bore axis, this creates a one-sided line contact 18 in the bore when the end of the second pin abuts in the bore. Furthermore, a surface contact 19 is created between the side of the format part which is facing the frame and a front surface of the holding element. A further surface contact 20, as shown in the top view in FIG. 7, is created between the holding element and the rear-side recess which is configured such that at least two opposing side surfaces of the holding element rest on the corresponding inner surface of the rear-side recess.

The holding element forms a fastening mechanism together with parts of the format part and the first and second pin. The above-described fastening mechanism blocks the movement of the format part in the following way:

The surface contact between the side of the format part which is facing the frame and the front surface of the holding element prevents the format part from rotating around the x-axis in positive direction by form closure and in negative direction by friction closure.

The two line contacts between bolt and receptacle prevent the downward movement of the format part (against the z-axis) and the movement transverse to the bolt axis (along the y-axis) by form closure. Moreover, the receptacle blocks a rotation around the z-axis by friction closure. The conical receptacle as is here shown with steep flanks is particularly suited. The above-described surface contacts restrict a lateral movement of the format part (in the length direction of the bolt and along the x-axis, respectively) and a rotation around the y-axis by way of form closure.

Furthermore, in the locked state the spring force of the compressed spring is divided by the conical contact surfaces into a y-component and a z-component, each resulting in a force-type closure. The z-component counteracts an upward movement of the format part (in z-direction). Moreover, as a result of the y-component, a force is operative in positive y-direction (i.e. towards the frame). The spring force (particularly the z-component) thereby also intensifies the above-described line contact between the bolt and the receptacle, so that the closure at that place is even intensified. The y-component also ensures the surface contact between the side of the format part facing the frame and the front surface of the holding element.

For the attachment of the above-described format part to a frame with the above-described holding element the format part is hung with its bolt into the conical receptacle and thereby also shifted over a part of the holding element. The format part is subsequently locked by the first pin being moved downwards until the second pin abuts in the bore and the spring is compressed.

Figure 8:
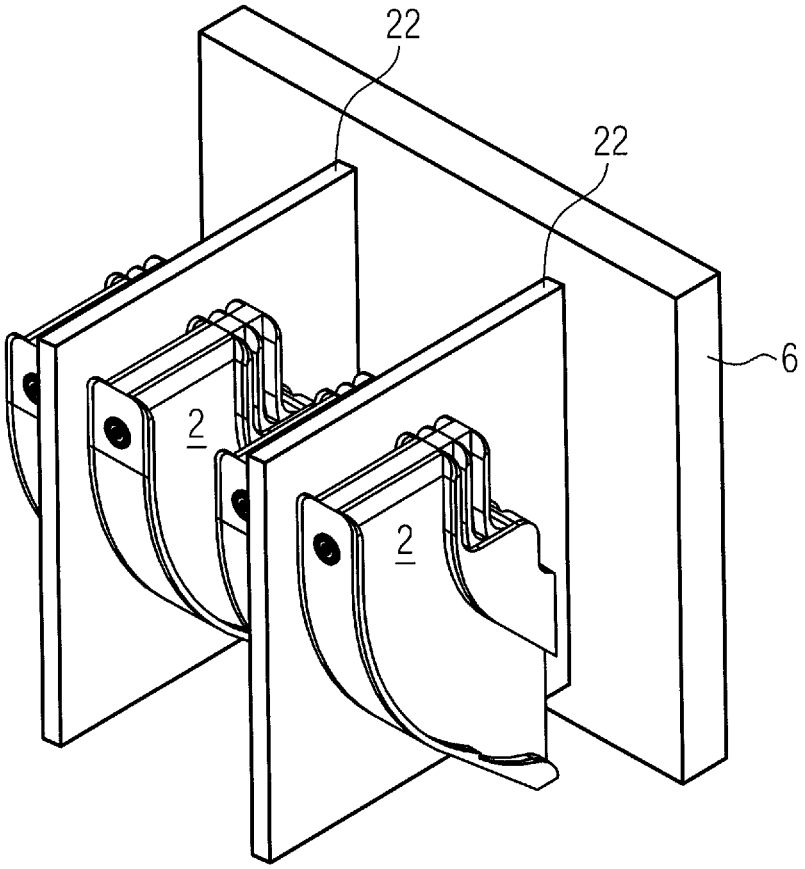
FIG. 8 is a schematic inclined view, which is not true to scale, onto a shaft system with lateral fastening of the format parts, according to some embodiments.

An alternative embodiment is shown in FIG. 8. A frame part 22 of the frame is here arranged between two neighboring receiving shafts, the frame part comprising a respective latching mechanism on its side walls. A format part is fastened by way of the latching mechanism to each side wall. It is only in the case of the outermost frame parts that a format part is fastened only to one side wall facing the receiving shaft. An advantage of this embodiment is that no two-sided and one-sided format parts have to be provided (depending on whether they are fastened at the edge or between two receiving shafts).

While there have been shown and described fundamental novel features of the invention as applied to the preferred and exemplary embodiments thereof, it will be understood that omissions and substitutions and changes in the form and details of the disclosed invention may be made by those skilled in the art without departing from the spirit of the invention. Moreover, as is readily apparent, numerous modifications and changes may readily occur to those skilled in the art. Hence, it is not desired to limit the invention to the exact construction and operation shown and described and, accordingly, all suitable modification equivalents may be resorted to falling within the scope of the invention as claimed. Features mentioned in the above-described embodiments are not restricted to these special combinations and are also possible in any desired other combinations. It is the intention, therefore, to be limited only as indicated by the scope of the claims appended hereto.

What is claimed is:

1. A shaft system comprising:

a plurality of exchangeable format parts forming walls of a plurality of receiving shafts arranged in parallel side by side for receiving foil bags, wherein at side surfaces of the format parts which guide the foil bags, the format parts have lateral recesses of a depth (d), the depth of the recesses of two neighboring format parts defining a width (b) of the receiving shaft formed between them and a shape of the recesses of two neighboring format parts defining a contour of the receiving shaft formed between them, wherein the width and/or the contour of the receiving shafts is changeable by replacing a first group of exchangeable format parts of said plurality of exchangeable format parts with a second group of exchangeable format parts of said plurality of exchangeable format parts, wherein each of the format parts of the first group comprises one or more recesses with a different depth and/or shape than the format parts of the second group; and a plurality of holding elements for fastening the format parts to a frame at a rear side of the receiving shafts, wherein each of said holding elements is fastened to a respective wall of the frame, the respective walls being fastened side by side to a cross beam, or wherein the holding elements are fastened side by side to a continuous wall of the frame.

2. The shaft system of claim 1, wherein during operation the format parts are fixed by way of a fastening mechanism that is independent of a format of the foil bags, the fastening mechanism comprising one or more elements of the format parts.

3. The shaft system of claim 2, wherein the elements of the format parts which form part of the fastening mechanism have the same shape in all of the format parts.

4. The shaft system of claim 2, wherein the fastening mechanism is configured such that all degrees of freedom of movement of the format parts are blocked when the format parts are in a fixed state.

5. The shaft system of claim 2, wherein the format parts are fixed in a purely mechanical manner and are maintained in their position solely by mechanical forces, without an electrical control to control the position.

6. The shaft system of claim 5, wherein the format parts are fixed by way of form, force and/or friction closure.

7. The shaft system of claim 2, wherein the fastening mechanism is configured to maintain the fixation upon interruption of an energy supply to the shaft system.

8. The shaft system of claim 2, wherein the fastening mechanism comprises at least one of a suspension mechanism and a locking mechanism.

9. The shaft system of claim 8, wherein the format parts each comprise a bolt, and wherein the suspension mechanism for each of the format parts comprises the bolt and a hook-like element on the holding element which forms an upwardly oriented receptacle configured to receive the bolt.

10. The shaft system of claim 8, wherein the format parts each comprise an element with a bore, and wherein the locking mechanism for each of the format parts comprises the element with the bore and a clamping mechanism.

11. The shaft system of claim 10, wherein the clamping mechanism comprises a force-actuated first pin extending through a passage opening that extends vertically through the holding element, and a second pin resiliently supported in the first pin, wherein the first pin is vertically movable along a z-axis and the second pin is vertically moveable in the second pin.

12. The shaft system of claim 11, further comprising a crossbar, wherein adjacently arranged first pins extend through passage openings in the crossbar and are firmly connected to the crossbar such that they are operated by adjustment of a height of the crossbar.

13. The shaft system of claim 11, further comprising an upwardly projecting actuating element for manual operation of the second pin.

14. The shaft system of claim 1, further comprising a sensor configured to detect whether a respective format part of said plurality of exchangeable format parts is hung in and/or locked.

15. The shaft system of claim 14, further comprising a warning system configured to issue a warning when the sensor detects that no format part of said plurality of exchangeable format parts is hung in and/or locked.

16. A shaft system comprising:

a plurality of exchangeable format parts forming walls between a plurality of receiving shafts arranged in parallel side by side for receiving foil bags, wherein at side surfaces of the format parts which guide the foil bags, the format parts have lateral recesses of a depth (d), the depth of the recesses of two neighboring exchangeable format parts of said plurality of exchangeable format parts defining a width (b) of the receiving shaft formed between them and a shape of the recesses of two neighboring exchangeable format parts of said plurality of exchangeable format parts defining a contour of the receiving shaft formed between them, wherein the width and/or the contour of the receiving shafts is changeable by replacing a first group of exchangeable format parts of said plurality of exchangeable format parts with a second group of exchangeable format parts of said plurality of exchangeable format parts, wherein each of the format parts of the first group comprises one or more recesses with a different depth and/or shape than the format parts of the second group; and a plurality of frame parts extending from a wall of a frame at a rear side of the receiving shafts and arranged between neighboring receiving shafts, wherein each format part is fastened to a side wall of a respective frame part.

* * * * *